US008602014B2

(12) United States Patent
Higgins et al.

(10) Patent No.: US 8,602,014 B2
(45) Date of Patent: Dec. 10, 2013

(54) CORNER JIG FOR MASONRY SAW

(76) Inventors: Joshua Higgins, Orange, CA (US); Ronald Higgins, Anaheim Hills, CA (US)

( * ) Notice: Subject to any disclaimer, the term of this patent is extended or adjusted under 35 U.S.C. 154(b) by 319 days.

(21) Appl. No.: 13/046,553

(22) Filed: Mar. 11, 2011

(65) Prior Publication Data

US 2012/0227726 A1 Sep. 13, 2012

(51) Int. Cl.
*B28D 1/04* (2006.01)

(52) U.S. Cl.
USPC ..... 125/14; 125/13.01

(58) Field of Classification Search
USPC ..... 451/364, 365, 41, 57, 58; 125/13.01, 14
See application file for complete search history.

(56) References Cited

U.S. PATENT DOCUMENTS

| | | | | |
|---|---|---|---|---|
| 3,090,615 | A * | 5/1963 | Morricy | 269/305 |
| 3,844,269 | A * | 10/1974 | Rater | 125/13.01 |
| 4,924,843 | A | 5/1990 | Waren | |
| 5,676,124 | A * | 10/1997 | Lee | 125/13.01 |
| 6,000,387 | A * | 12/1999 | Lee | 125/13.01 |
| 6,347,624 | B1 * | 2/2002 | Smith et al. | 125/13.01 |
| 6,401,706 | B1 | 6/2002 | Hernblom et al. | |
| 7,987,752 | B2 * | 8/2011 | Tsung et al. | 83/169 |

OTHER PUBLICATIONS

"Cee-Jay Tool Rock Magazine: Introducing a New Tool for the Thin Veneer Stone Industry", Cee-Jay Tool Company, Inc. pamphlet, 1 page.
"V30 Thin Veneer Saw: A New Angle on Thin Veneer Processing", Cee-Jay Tool Company, Inc. pamphlet, 2 pages.
"Thin Veneer Corner", Cee-Jay Tool Company, Inc. Youtube.com. http://www.youtube.com/watch?v=EyopxZPyWg&NR=1.
"Thin Veneer Stone", Cee-Jay Tool Company, Inc. Youtube.com. http://www.youtube.com/watch?v=5BvqTOevLGg &feature=related.
"Electric Powered 14" Masonry Saw Parts List Manual", EDCO. pamphlet, 11 pages.

* cited by examiner

*Primary Examiner* — Robert Rose
(74) *Attorney, Agent, or Firm* — Stetina Brunda Garred & Brucker

(57) ABSTRACT

A corner jig for a masonry saw for fabricating a cut in a masonry unit (e.g., brick) such as to form a corner brick veneer may have a push block wherein its height is substantially equal to a length of a brick to be formed into the corner brick veneer. A lateral position of a cut guide is adjustable to regulate a thickness of the corner brick veneer. A height of the cut guide may also be substantially equal in length of the bring to be formed into the corner brick veneer. Once the cut guide and push block are mounted to the masonry saw, the brick is positioned within the corner jig and a first cut is made. The user's hands are out of the way so that the cut can be made safely without harming the operator. The brick is repositioned and a second cut is made in the brick to finish off the corner brick veneer. Once again, the user's hands are out of the way for safe operation of the masonry saw. Moreover, no subsequent cuts or finishing step are required to provide for a clean square interior corner of the corner brick veneer.

4 Claims, 7 Drawing Sheets

FIG. 1
(PRIOR ART)
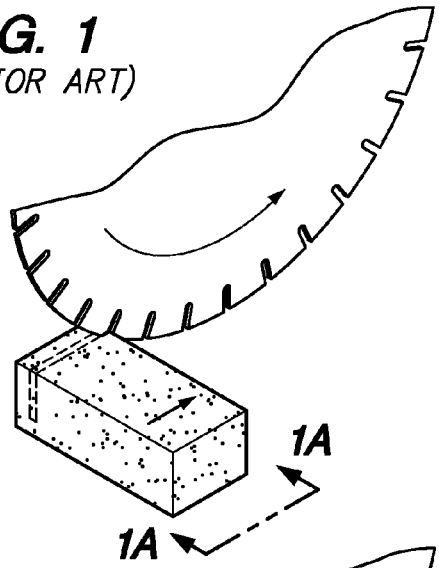
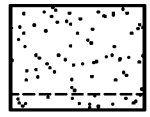
FIG. 1A
(PRIOR ART)
FIG. 2
(PRIOR ART)
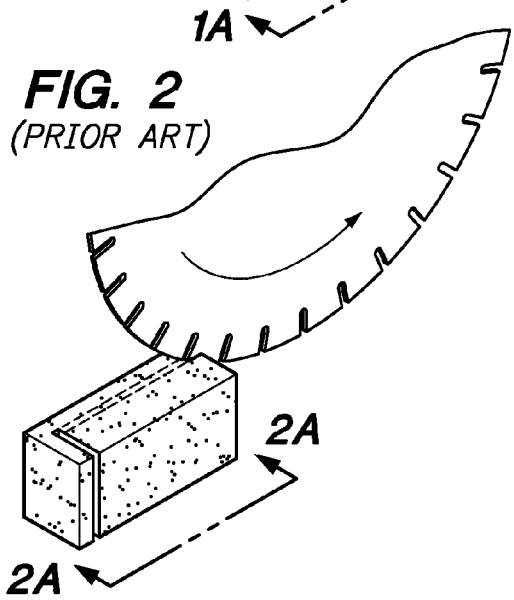
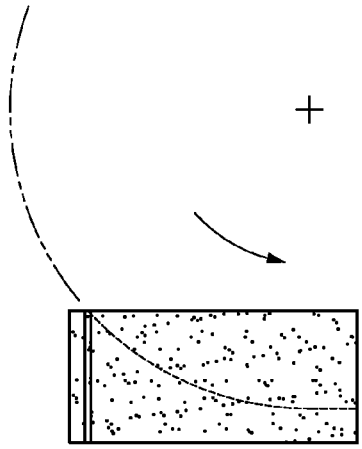
FIG. 2A
(PRIOR ART)
FIG. 3
(PRIOR ART)
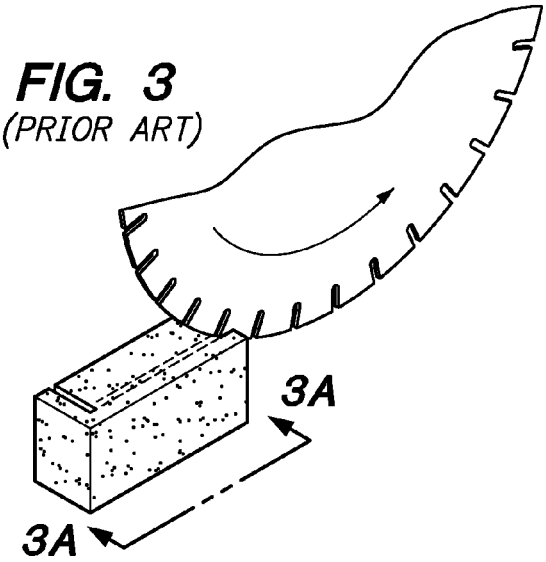
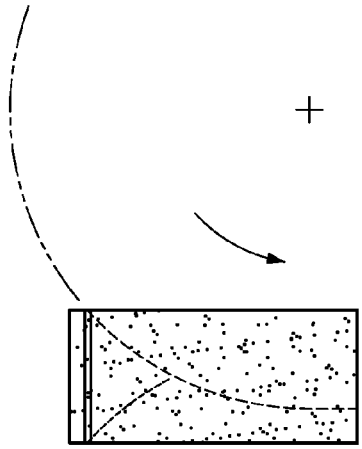
FIG. 3A
(PRIOR ART)

CORNER JIG FOR MASONRY SAW

CROSS-REFERENCE TO RELATED APPLICATIONS

Not applicable

STATEMENT RE: FEDERALLY SPONSORED RESEARCH/DEVELOPMENT

Not applicable

BACKGROUND

The embodiments disclosed herein relate to a corner jig mountable to a masonry saw for fabricating a corner brick veneer or a corner jig integrated into a rolling table or rolling carriage of a masonry saw for cutting a masonry unit such as brick, stone, block, concrete pavers, tile, etc.

A corner brick veneer is fabricated from a square brick. In particular, a blade of the masonry saw makes a first pass through the brick to form a channel, as shown in FIG. 1. FIG. 1A illustrates a side view of the brick shown in FIG. 1 after the blade has made the first cut. The blade cuts an even slot through the entire brick. The brick in repositioned as shown in FIG. 2 so that the blade can make a second cut through the brick. However, as shown in FIG. 2A, due to the radius or curvature of the blade, the blade does complete the cut to finish off the corner brick veneer. Rather, the lower portion of the brick below the blade is untouched. The blade does not cut through the entire brick since doing so would damage the aesthetic value of the brick. To complete the cut, the operator conducts two more steps as shown in FIGS. 3, 3A and 4. In FIG. 3, the brick is repositioned to make a cut on the opposite side of the brick compared to the position of the brick shown in FIG. 2. FIG. 3A illustrates the cut made by the blade during this pass. Unfortunately, the long portion of the corner brick veneer is weakened by the cut made in FIG. 2 and could cause the long portion to break off if the blade is not perfectly aligned to the cut made in FIG. 2A. As can be seen in FIGS. 3A and 4, a small portion of the brick on the interior corner still remains. The interior corner of the brick veneer is not squared. FIG. 4 illustrates the final finishing cut wherein the operator holds the corner brick veneer and cuts off the last remaining portion so that the interior surface can lay flush against a wall or other surface. The interior surface of the corner brick veneer has a square configuration without any leftover pieces that would prevent the corner brick veneer from laying flat against the corner.

Unfortunately, the above prior art process weakens the corner brick veneer. Sometimes, the corner brick veneer is destroyed during the step shown in FIG. 3. One side of the brick has already been cut with the saw shown in FIG. 2. If the brick is not held so that the blade is perfectly aligned to the slot formed in FIG. 2, the blade could break off the long portion of the corner brick veneer. Additionally, the above mentioned prior art method is extremely dangerous. The operator's hands are not protected from the blade. Rather, the operator must hold the brick free hand during the step shown in FIG. 3. The reason is that the fence or cut guide is set to the thickness of the corner brick veneer and used to make the cuts shown in FIGS. 1 and 2. In order to save time, the cut guide or fence is not readjusted for the cut shown in FIG. 3. Rather, the brick is held free hand above the cut guide or fence in FIG. 3 and guided into the blade. It is during this process that the blade can place undue pressure on the brick and consequently crumble the brick and destroy the corner brick veneer. Additionally, the operator is holding the corner brick veneer free hand to finish off the corner brick veneer as shown in FIG. 4. The free hand hold of the brick is extremely dangerous since any misstep or lapse in judgment may cause the blade to cut the user's hand, arms or other body parts.

Accordingly, there is a need in the art for an improved method and device for cutting a brick into a corner brick veneer.

BRIEF SUMMARY

The corner jig and the improved masonry saw disclosed herein addresses the needs discussed above, discussed below and those that are known in the art.

The corner jig has a push block that supports a brick even when the brick is laid on a work surface of the corner jig with its longest side up. A cut guide is laterally adjustable to determine a thickness of the corner brick veneer. With the push block and the cut guide in the proper position, the brick is inserted into the corner jig. The blade makes a first cut. The brick is repositioned for a second cut in which the corner brick veneer is finished. No other finishing cuts are necessary. During each of the cuts, the brick is firmly held within the corner jig to reduce any possibility of breaking the corner brick veneer during the cutting process. Additionally, the operator's hands are kept away from the blade to mitigate accidents. The brick is never held free hand.

More particularly, a masonry saw for cutting a corner brick veneer is disclosed. The saw may comprise a diamond covered blade, a carriage, a work surface, a push block, and an elongate cut guide. The blade may rotate about an arbor. The blade may define a side face. The carriage may be traversed back and forth defining a carriage direction which is parallel to the blade side face. The carriage may be disposed under the blade. The work surface may be disposed on the carriage and under the blade. The push block is preferably attached to the work surface. The push block is also preferably disposed immediately on a right side of the blade. The push block defines a height which is at least about ½ of a height of the corner brick veneer. The elongate cut guide is disposed on the work surface and on a left side of the blade and the push block. The elongate cut guide also has a height which is at least about ½ of the height of the corner brick veneer. The elongate cut guide may be fixed and also movable along a lateral direction which is perpendicular to the carriage direction. A lateral position of the elongate cut guide determines a thickness of the corner brick veneer.

The work surface may be integrated into the carriage. Alternatively, the work surface, push block and elongate cut guide may be an integral part of a corner jig which is removably mountable to the carriage. The work surface, push block and the elongate cut guide may be secured to a front plate of the carriage.

A top end of the push block may be closer to the arbor of the blade than the work surface. Also, a top end of the cut guide may be closer to the arbor of the blade than the work surface.

Additionally, a corner jig for cutting a corner brick veneer is disclosed. The corner jig may be mountable to a masonry saw. A blade of the masonry saw may define a side face. A carriage which is traversable back and forth may define a carriage direction. The corner jig may comprise a work surface, a push block, a work surface and an elongate cut guide. The work surface may be disposed on a rolling carriage of the masonry saw and under the blade of the masonry saw. The push block may be secured to the work surface. The push block may be disposed on a right side of the blade. The push block may have a height which is at least about ½ of the height of the corner brick veneer. The push block may have a flat front surface perpendicular to the carriage direction. The elongate cut guide may be disposed on the work surface and on a left side of the blade and the push block. The elongate cut guide may have a height which is at least about ½ of the height of the corner brick veneer. The elongate cut guide may be fixed and movable along a lateral direction. The cut guide may define a guide surface parallel to the carriage direction. A lateral position of the elongate cut guide may determine a thickness of the brick veneer.

A front surface of the push block may be parallel to a front edge of the work surface for aligning the push block to the blade of the saw.

The elongate cut guide may be attached to a mounting block which is removably securable to a front plate of the saw.

A top end of the push block may be closer to the arbor of the blade than the work surface. Also, a top end of the cut guide may be closer to the arbor of the blade than the work surface.

Additionally, a method for cutting a corner brick veneer with a masonry saw is disclosed. The method may comprise the steps of adjusting a lateral position of an elongate cut guide to adjust a thickness of the corner brick veneer; positioning a brick against the cut guide and a push block to provide stability when cutting the brick and for cutting a first cut in the corner brick veneer; pushing a carriage of the masonry saw to complete a first pass of a blade through the brick, the first pass forming the first cut which is parallel to a first side of the brick, the first cut forming a channel having a straight bottom surface extending to opposed sides of the brick; repositioning the brick in the corner jig for cutting a second cut in the corner brick veneer, the second cut being parallel to an adjacent second side of the brick and perpendicular to the first cut; pushing the carriage of the masonry saw to complete a second pass of the blade through the brick, the second pass forming the second cut which is parallel to the adjacent second side of the brick, the second cut cutting off a waste portion of the brick and finishing an interior corner of the corner brick veneer.

The method may further comprise the step of forming a square interior corner of the corner brick veneer during the step of pushing the carriage of the masonry saw to complete the second pass.

The method may further comprise the step of aligning a push block to a carriage direction of the saw. The aligning step may comprise the step of registering a front edge of a work surface attached to the push block to a front plate of the saw.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 1 illustrates a prior art first step in fabricating a corner brick veneer from a square brick;

FIG. 1A is a side view of the brick shown in FIG. 1 after a blade has made a first cut in the brick, wherein the first cut provides an even channel throughout the entire brick;

FIG. 2 is an illustration of a prior art second step for fabricating the corner brick veneer;

FIG. 2A is a side view of the brick shown in FIG. 2 illustrating an uneven cut due to the radius of the blade;

FIG. 3 is an illustration of a prior art third step for fabricating the corner brick veneer;

FIG. 3A is a side view of the brick shown in FIG. 3 illustrating an incomplete cut from the blade shown in FIG. 3;

DETAILED DESCRIPTION

Figure 4:
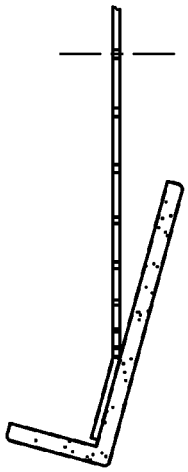
FIG. 4 (PRIOR ART)
FIG. 4 is an illustration of a prior art fourth step in finishing the corner brick veneer to square an interior corner of the corner brick veneer.

Referring now to the drawings, an improved masonry saw 10 and a method for fabricating a corner brick veneer 12 is shown. The improved masonry saw 10 cuts a square brick 14 (see FIG. 6) into a corner brick veneer 12 (see FIG. 5A) with two passes of the square brick 14 through the blade 16 as shown representatively by FIGS. 8 and 9. After the second pass shown in FIG. 9, the square brick 14 (see FIG. 6) is fabricated into a corner brick veneer 12 shown in FIG. 5A. A waste portion 18 is discarded after the second pass shown in FIG. 9. An interior corner 76 of the corner brick veneer 12 requires no rework or finishing. After the second cut, the interior corner of the corner brick veneer is squared. The device and method described herein allows an operator to safely cut the corner brick veneer 12, have less waste due to operator error, and be more time efficient so that an operator may produce more corner brick veneers 12 in a given amount of time compared to prior art methods or with prior art machines.

The embodiments discussed herein are made in relation to a masonry saw that cuts a brick, and more particularly, a corner jig used in conjunction with the masonry saw to cut the brick into a corner brick veneer. However, the corner jig discussed herein may be utilized to make cuts in a masonry unit (e.g., brick, stone, block, tile, etc.) in a safe manner so that the user's fingers and other body parts are not exposed to the blade of the masonry saw. The cut may be channel or a through cut to cut the masonry unit into two different pieces.

Figure 5:
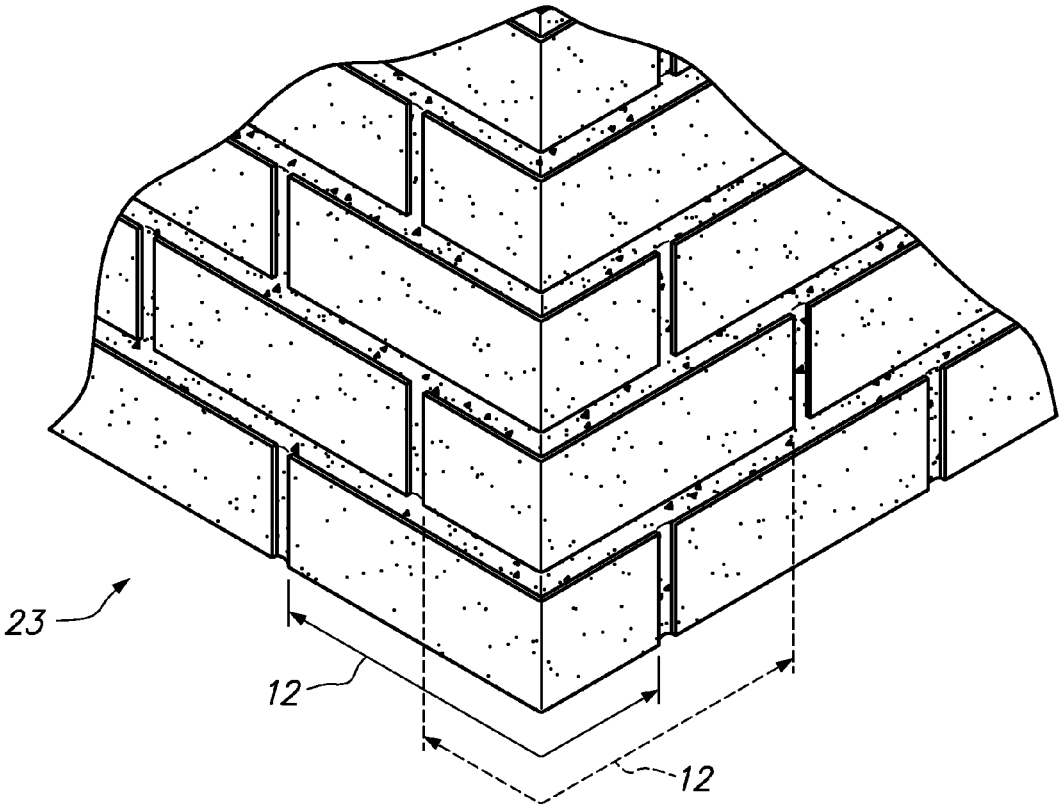
FIG. 5 is an illustration of a plurality of corner brick veneers being applied to a wall.
Figure 5A:
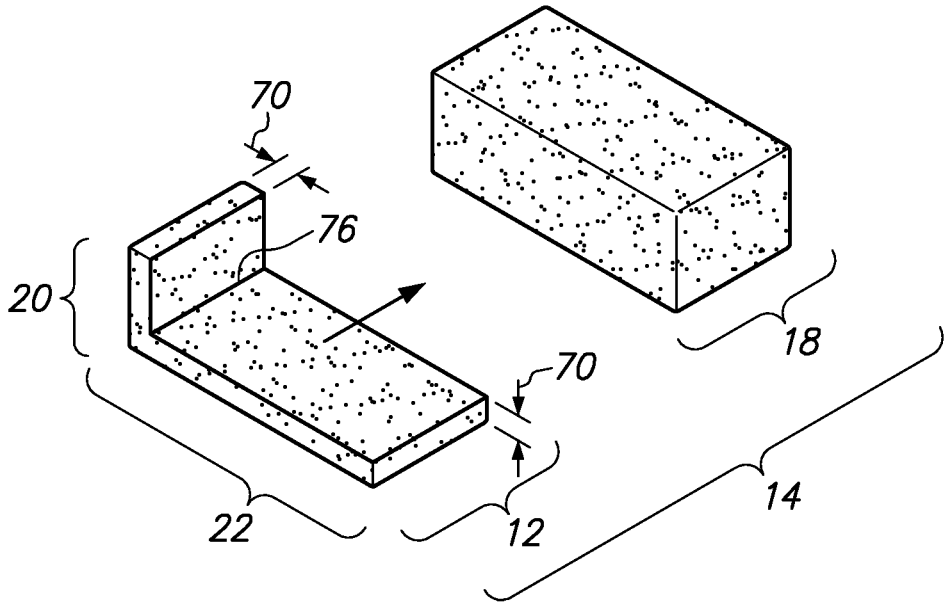
FIG. 5A illustrates one corner brick veneer wherein its waste portion is removed.

More particularly, the masonry saw 10 with corner jig 42 (see FIG. 7) cut a square brick 14 (see FIG. 6) into a corner brick veneer 12 (see FIG. 5A). The corner brick veneer 12 has an L shaped configuration which defines a short portion 20 (see FIG. 5A) and a long portion 22. The short and long portions 20, 22 may be perpendicular to each other, as shown in FIG. 5A. When the corner brick veneer 12 is installed on a wall 23 (see FIG. 5), the corner brick veneer 12 provides the impression that the entire wall is fabricated from brick 14, but in actuality the corner brick veneer 12 provides no structural support to the wall 23. The corner brick veneer 12 may be utilized in various other situations such as sidewalks, driveways, etc. and anywhere where showing a thickness of the brick 14 is aesthetically pleasing.

Figure 8:
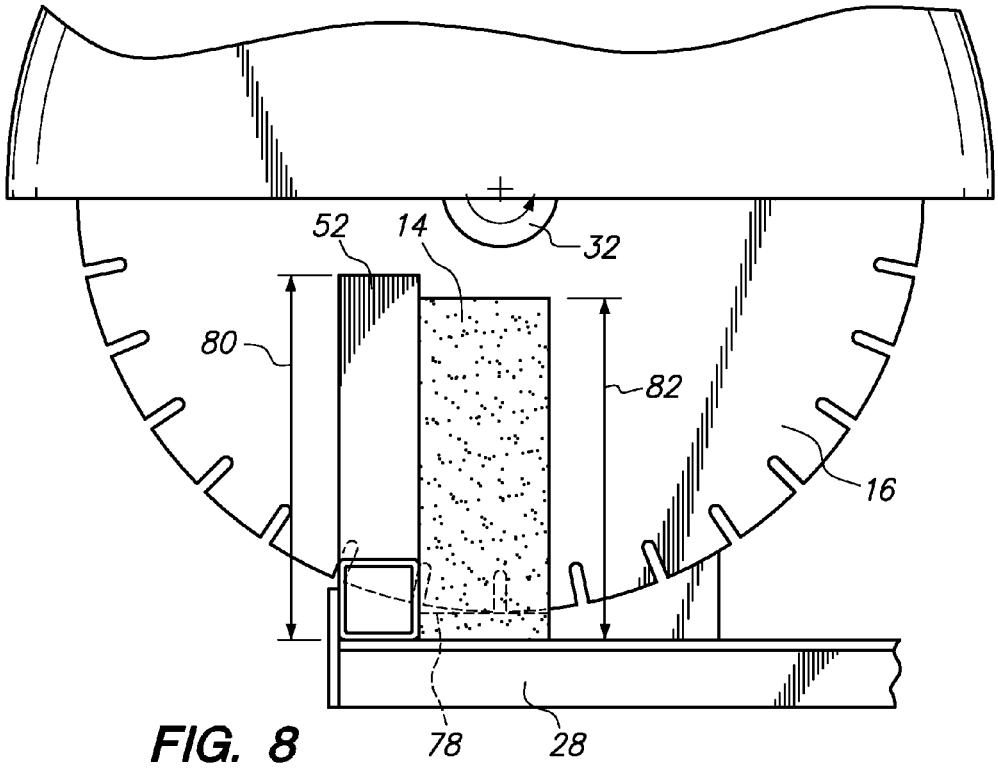
FIG. 8 is a side view of the masonry saw and corner jig shown in FIG. 6 after a blade of the masonry saw has made a first cut through the brick illustrating a clean cut through the brick to form a channel through the brick.
Figure 9:
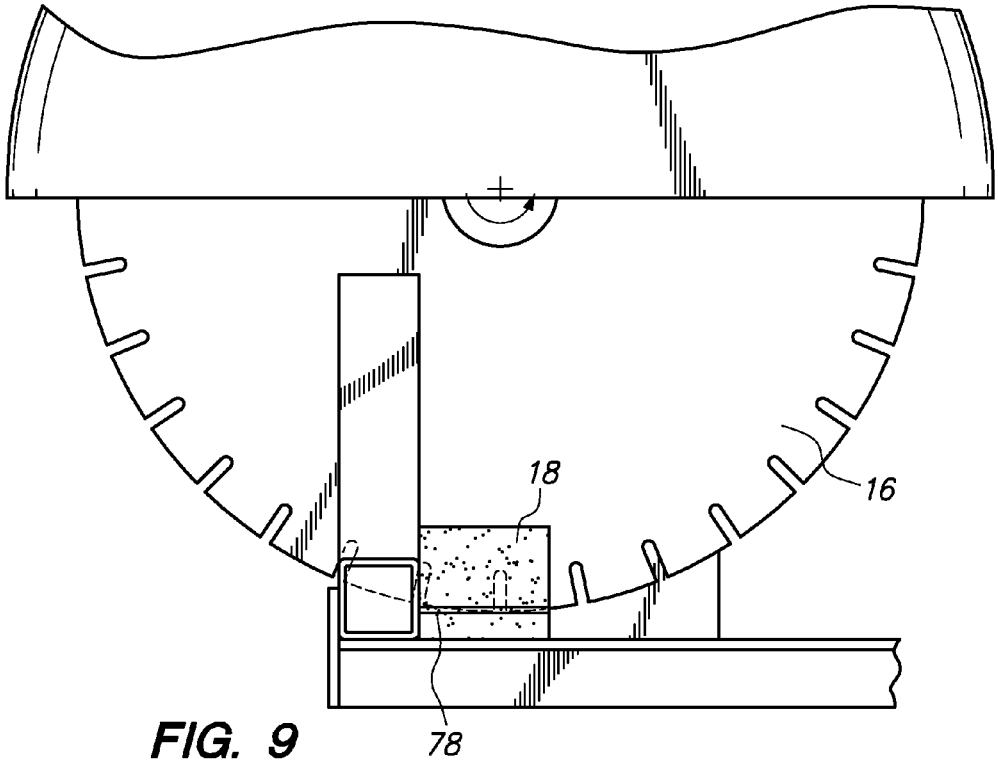
FIG. 9 is a side view of the masonry saw and corner jig shown in FIG. 6 during a second pass of the blade through the brick.

The masonry saw 10 may have an arm 24 that suspends a rotating blade 16 above a work surface 26 of a rolling table or carriage 28. The rolling table 28 is traversable in a back and forth motion in a direction shown by arrow 30. The blade 16 rotates about an arbor 32 that defines the rotating axis 34 of the blade 16 and turns in the direction of arrow 36. The blade 16 defines opposed side surfaces, namely, a right side surface 38 and a left side surface 40. The direction of the forward and back motion 30 of the work surface 26 of the rolling table 28 is parallel to the right and left side surfaces 38, 40 of the blade 16 and perpendicular to the rotating axis 34 of the blade 16. When the brick 14 is held on the work surface 26 and fed through the blade 16, a straight channel is cut through the brick 14 without binding the brick 14 against the blade 16 as shown in FIGS. 8 and 9.

Figure 6:
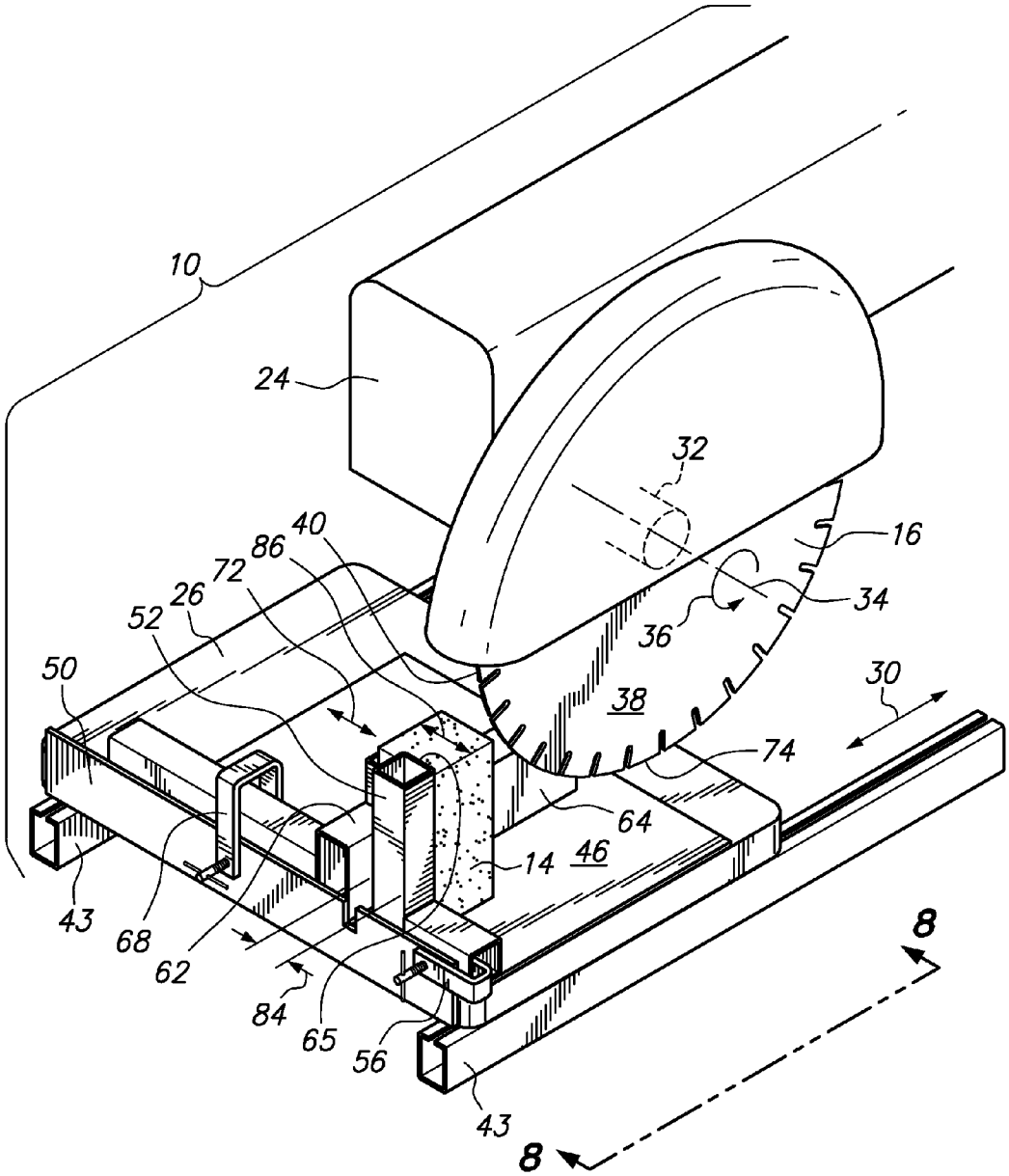
FIG. 6 is a perspective view of a masonry saw with a corner jig mounted thereto for fabricating the corner brick veneer.
Figure 7:
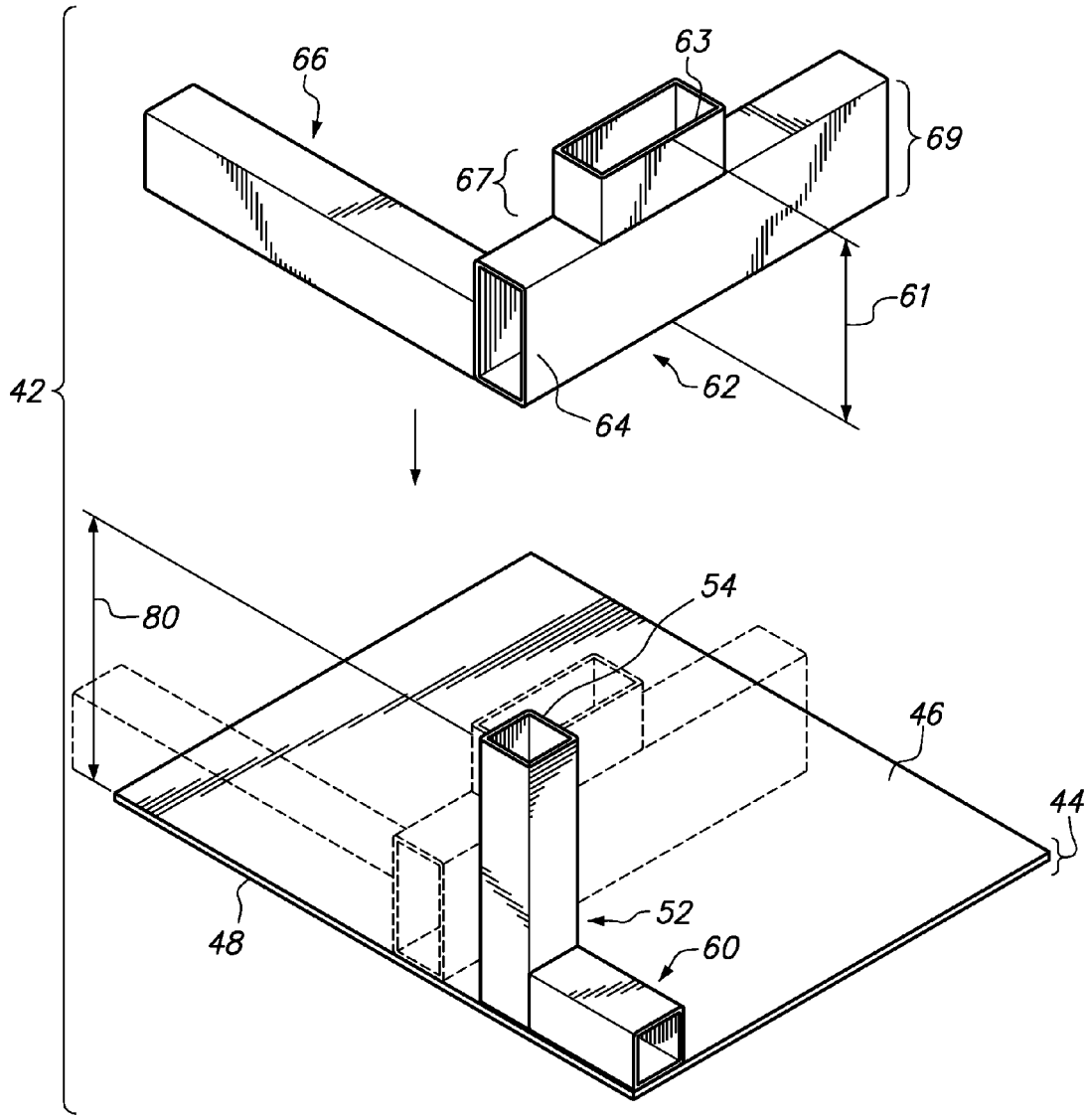
FIG. 7 is an exploded perspective view of the corner jig shown in FIG. 6.

The corner jig 42 (see FIG. 7) may be mounted on top of the work surface 26 of the rolling table 28 that slides back and forth on rails 43 in the direction of arrow 30. The corner jig 42 may include a flat plate 44 that defines a work surface 46 of the corner jig 42. When the corner jig 42 is mounted to the work surface 26 of the rolling table 28, the work surface 46 of the corner jig 42 now supports the brick 14 to be worked. The flat plate 44 preferably has a straight front edge 48 (see FIG. 7) that is registered (i.e., bumped up against) a front panel 50 (see FIG. 6) of the rolling table 28 to square a push block 52 of the corner jig 42 to the blade 16. In particular, the push block 52 may be a square tubing with a flat front face 54 (see FIG. 7). The flat front face 54 receives the brick 14. Preferably, the flat front surface 54 of the push block 52 is perpendicular to the right side surface 38 of the blade 16. To square the push block 52, the front edge 48 may be fabricated to be parallel to the front surface 54. When the front edge 48 of the flat plate 44 is registered to the front panel 50, the flat front surface 54 is registered to the blade 16. The flat plate 44 may additionally have a mounting block 60. The mounting block 60 may be fabricated from a square tubing and be welded to the flat plate 44. A c-clamp 56 may be used to secure the flat plate 44 and the push block 52 to the rolling table 28 that defines the work surface 26 of the masonry saw 10. The c-clamp 56 secures the mounting block 60 to the front panel 50 and also remains out of the way by clamping to the inside of the square tubing of the mounting block 60. The flat plate 44 provides sufficient rigidity to the push block 52 so that the forces that the blade 16 imposes on the push block 52 does not bend the push block 52 during use. As shown in FIG. 6, the brick 14 is laid against the flat front surface 54 of the push block 52. Once the brick 14 is in place, the user pushes the rolling table 28 forward so that the blade 16 can make a channel in the brick 14, as shown in FIG. 8. The user's fingers are safely out of the way and cannot be cut by the blade 16. Preferably, the push block 52 is immediately on the right hand side of the blade 16 to provide maximum leverage and stability to the brick 14 as the push block 52 pushes the brick 14 and the blade 16 is cutting through the brick 14.

The push block 52 as discussed above has a flat front surface 54. The push block 52 preferably has a height 80 (see FIG. 7) that is at least one half of a length 82 (see FIG. 8) of the brick 14. In FIG. 8, the height 80 of the push block 52 is shown as being longer than the height 82 of the brick 14. Moreover, the height 80 of the push block 52 is preferably lower than the arbor 32 of the masonry saw 10 that holds the blade 16. Generally, a top end 65 of the push block 52 may be closer to the arbor 32 of the blade 16 than the work surface 42. Moreover, the push block 52 may have a width 84 (see FIG. 6) which is about one half a width 86 of the brick 14. The substantial size of the push block 52 provides for significant support to the brick 14 as the brick 14 is being cut by the blade 16 when the brick 14 is laid on its end as shown in FIGS. 6 and 8.

The corner jig 42 may also include a cut guide 62. The cut guide 62 is disposed on top of the work surface 46 of the flat plate 44. The cut guide 62 additionally defines a guide surface 64. The guide surface 64 is generally flat and is parallel to the blade 16 as well as the direction 30 of travel of the rolling table 28. The guide surface 64 is also perpendicular to the flat front surface 54 of the push block 52. The cut guide 62 preferably has a height 61 that is at least one half of the length 82 (see FIG. 8) of the brick 14. Generally, a top end 63 of the cut guide 62 may be closer to the arbor 32 of the blade 16 than the work surface 46. To increase the height of the cut guide 62, a lateral block 67 may be mounted on top of the lower elongate tubing 69. The medial surface of the lateral block 67 may be flush with the medial surface of the lower elongate tubing 69. The tall cut guide 62 stabilizes the brick 14 so that the brick 14 does not move side of side or laterally when being cut in the position shown in FIG. 6. When the brick 14 is positioned within the corner jig 42, the brick 14 is supported by both the tall cut guide 62 and the tall push block 52 to stabilize the brick 14 when the brick is positioned on its ends as shown in FIG. 6. the blade 16 forms a channel or slot 84 that is parallel to the side surface of the brick 14 contacting the guide surface 64 and perpendicular to the adjacent side surface of the brick 14 contacting the front flat surface 54 of the push block 52. The cut guide 62 may be mounted on top of the flat plate 44 by clamping a mounting block 66 attached to the cut guide 62 to the front panel 50 by way of c-clamp 68.

To mount the corner jig 42 on the masonry saw 10, the flat plate 44 along with the push block 52 and the mounting block 60 attached thereto are first laid on top of the work surface 26 of the rolling table 28. The front edge 48 of the flat plate 44 is bumped up against the front panel 50. The push block 52 is positioned just right of the blade 16 so that the push block 52 does not touch the blade 16 when the rolling table 28 is pushed forward in direction 30. After positioning the push block 52 on the right side of the blade 16, c-clamp 56 secures the flat plate 44 to the rolling table 28. Thereafter, the cut guide 62 is mounted to the rolling table 28. The cut guide 62 is placed on top of the flat plate 44. The cut guide 62 is gaped away from the blade 16 so as to define a width 70 (see FIG. 5A) of the short and long portions 20, 22 of the corner brick veneer 12 to be cut. A mounting block 66 attached to the cut guide 62 is squared to the guide surface 64 of the cut guide 62 so that when the mounting block 66 is clamped to the front panel 50, the guide surface 64 is parallel to the blade 16. The cut guide 62 can be adjusted laterally as shown by directional arrow 72 to adjust the thickness 70 of the short and long portions 20, 22 of the corner brick veneer 12. After the desired gap between the guide surface 64 of the cut guide 62 to the blade 16 is achieved, the c-clamp 68 locks the lateral position of the cut guide 62. To finish setup of the masonry saw 10, the blade 16 is raised or lowered so that the bottom 74 of the blade 16 does not contact the work surface 46 of the flat plate 44. Preferably, the blade 16 is raised and lowered so that the bottom 74 is gaped away from the work surface 46 the same distance as the guide surface 64 is gapped away from the blade 16. When the brick 14 is cut as shown in FIGS. 8 and 9 the blade 16 makes two straight channels through the brick 14 to form a clean interior corner 76. No after work is required Initially, the square brick 14 is positioned in the corner jig 42 as shown in FIG. 6. The brick 14 is positioned on its end to cut the long horizontal slot 84 first. The blade 16 cuts through the square brick 14. The rolling table 28 is pushed completely forward so that the blade 16 forms the slot 78 as shown in FIG. 8. The user's fingers are safely out of the way when this first cut is made. After the slot 78 is formed in the brick 14, the brick 14 is repositioned as shown in FIG. 9. The brick 14 is laid on its side so that the blade 16 can cut through the square brick 14 and the waste portion 18 can be removed. The blade 16 cuts through the entire brick 14 in the second pass shown in FIG. 9. The second pass forms a clean interior corner 76 so that the corner brick veneer 12 can be laid against a corner of a wall 23 or other structure. During the second pass, the user's hands are also safely out of the way so that the user's fingers cannot be cut by the blade.

It is also contemplated that a cut along the short direction of the brick 14 may be made first. Thereafter, a cut along the long direction of the brick 14 may be made to finish off the corner brick veneer 12 and to remove the waste portion 18.

Figure 10:
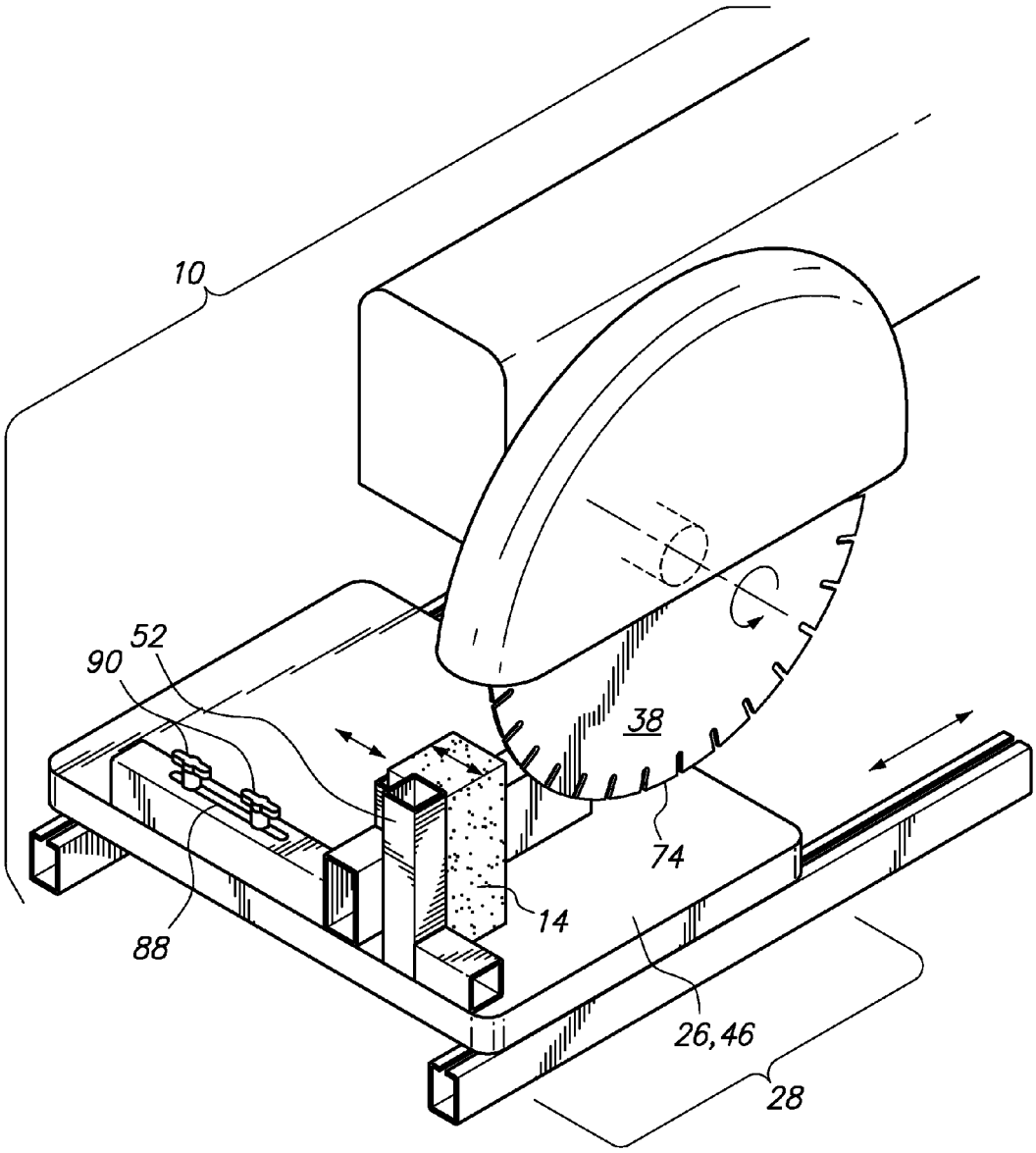
FIG. 10 is a perspective view of an improved masonry saw wherein the corner jig is integrated into a rolling table or carriage of the masonry saw.

It is also contemplated that the flat plate 44 may be integrated into the rolling table 28, as shown in FIG. 10. In particular, the work surface 26 of the rolling table 28 may define the work surface 46. The push block 52 is integrated into the rolling table 28 or attached (e.g., welded) to the rolling table 28. The cut guide 62 is laterally traversable on the rolling table 28. The cut guide 62 can be secured to the work surface 26, 46 by way of slot 88, bolts 90 threaded into the rolling table 28 When the masonry saw 10 is used to fabricate a corner brick veneer 12, the rolling table 28 originally provided with the masonry saw 10 may be replaced with the rolling table 28 with integrated corner jig 42. The two rolling tables 28 may be interchanged depending on the work required.

The corner jig discussed herein is shown as being fabricated from square tubing with open ends. However, it is contemplated that the ends of the open tubing may be closed off with a cap. Moreover, the corner jig discussed herein is shown and described in relation to a right handed masonry saw. However, it is contemplated that the corner jig may also be used in relation to a left handed saw provided that the various components of the corner jig are mirrored so as to fit the left handed masonry saw. The concepts discussed herein may be used in relation to various sizes of masonry saws and are not limited to the sizes shown in the drawings.

The corner jig 42 discussed herein was described in relation to use of both the push block 52 and the cut guide 62 in combination with each other. However, it is also contemplated that the cut guide 62 alone without the push block 52 can be used to make a cut in a masonry unit. In particular, the cut guide 62 can be placed on top of the work surface 26 instead of the work surface 46. The cut guide 62 is squared to the blade 16 by mounting the mounting block 66 to the front panel 50. The cut guide 62 is positioned laterally based on a desired cut to the masonry unit. The masonry unit is placed against the cut guide 62 and the cut is made. The work surface 26 may have a groove so that the blade 16 of the masonry saw can be lowered and cut through the entire masonry unit.

The above description is given by way of example, and not limitation. Given the above disclosure, one skilled in the art could devise variations that are within the scope and spirit of the invention disclosed herein, including various ways of making the cut guide 62 laterally movable and securable. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method for cutting a corner brick veneer with a masonry saw, the method comprising the steps of:

adjusting a lateral position of an elongate cut guide to adjust a thickness of the corner brick veneer;

positioning a brick against the cut guide and a push block to provide stability when cutting the brick and for cutting a first cut in the corner brick veneer;

pushing a carriage of the masonry saw to complete a first pass of a blade through the brick, the first pass forming the first cut which is parallel to a first side of the brick, the first cut forming a channel having a straight bottom surface extending to opposed sides of the brick;

repositioning the brick in the corner jig for cutting a second cut in the corner brick veneer, the second cut being parallel to an adjacent second side of the brick and perpendicular to the first cut;

pushing the carriage of the masonry saw to complete a second pass of the blade through the brick, the second pass forming the second cut which is parallel to the adjacent second side a the brick, the second cut cutting off a waste portion of the brick and finishing an interior corner of the corner brick veneer.

2. The method of claim 1 further comprising the step of forming a square interior corner of the corner brick veneer during the step of pushing the carriage of the masonry saw to complete the second pass.

3. The method of claim 1 further comprising the step of aligning a push block to a carriage direction of the saw.

4. The method of claim 3 wherein the aligning step comprises the step of registering a front edge of a work surface attached to the push block to a front plate of the saw.

* * * * *